US007501909B2

(12) United States Patent
Keating et al.

(10) Patent No.: US 7,501,909 B2
(45) Date of Patent: Mar. 10, 2009

(54) WIDE-BANDWIDTH POLARIZATION MODULATOR FOR MICROWAVE AND MM-WAVELENGTHS

(75) Inventors: Brian Gregory Keating, La Jolla, CA (US); Andrew E. Lange, La Canada, CA (US)

(73) Assignee: California Institute of Technology, Pasadena, CA (US)

( * ) Notice: Subject to any disclaimer, the term of this patent is extended or adjusted under 35 U.S.C. 154(b) by 354 days.

(21) Appl. No.: 11/450,753

(22) Filed: Jun. 9, 2006

(65) Prior Publication Data

US 2006/0279373 A1 Dec. 14, 2006

Related U.S. Application Data

(60) Provisional application No. 60/689,740, filed on Jun. 9, 2005.

(51) Int. Cl.
*H01P 1/165* (2006.01)

(52) U.S. Cl. ..... 333/21 A; 333/24.3

(58) Field of Classification Search ..... 333/21 A, 333/21 R, 137, 135, 208, 113, 157, 248, 24.3
See application file for complete search history.

(56) References Cited

U.S. PATENT DOCUMENTS

| | | | | |
|---|---|---|---|---|
| 3,772,619 | A | 11/1973 | Clarricoats | |
| 4,467,292 | A | 8/1984 | Ajioka et al. | |
| 4,884,045 | A | 11/1989 | Alverson et al. | |
| 5,229,737 | A * | 7/1993 | Prime | 333/24.3 |
| 6,963,253 | B2 | 11/2005 | Kovac et al. | |

OTHER PUBLICATIONS

G.P. Srivastava, P.C. Kothari, "Microwave Faraday effect in n type germanium", J. Phys. D:Appl.Phs., vol. 5, 1972, 5 pgs.

Thesis entitled "Polarization of the Blackbody-Radiation at 3.2 com" by Nanos, George Peter Jr., Affiliation AA Princeton University; Journal: Thesis (Ph.D.)—Princeton University, 1974; Dissertation Abstracts International, vol. 35-02, Section B, p. 0651 published 1974, 6 pgs.

Keating, B.G., Ade, P.A., Bock, J.J., Hivon, E., Holzapfel, W.L., Lange, A.E., Nguyen, H. & Yoon, K.W., "BICEP: A Large Angular Scale CMB Polarimeter", Polarimetry in Astronomy, ed. Silvano Fineschi; proceedings of the SPIE, vol. 4843 Mar. 2003, 12 pgs.

C.L. Hogan, "The Ferromagnetic Faraday Effect at Microwave Frequencies and its Applications—The Microwave Gyrator", The Bell System Technical Journal, Jan. 1952, pp. 1-31, vol. XXXI, No. 1.

* cited by examiner

*Primary Examiner*—Stephen E Jones
(74) *Attorney, Agent, or Firm*—Hiscok & Barclay, LLP; Joseph B. Milstein

(57) ABSTRACT

A polarization modulator device for modulating a polarization of an electromagnetic wave includes a corrugated metallic waveguide having an interior cylindrical opening defined therein and situated along a longitudinal axis of the waveguide. The corrugated metallic waveguide also has a first waveguide section and a second waveguide section. The waveguide sections are separated by a dielectric break. A central structure is situated along the longitudinal axis of the waveguide. The central structure is supported substantially in the center of the interior cylindrical opening of the waveguide. The cylinder is substantially situated within the dielectric break of the waveguide. A magnetic field source is configured to permit a controllable magnetic field in the cylinder, wherein the magnetic field modulates a polarization of the electromagnetic wave by an angle related to the strength of the magnetic field. A polarimeter using the polarization modulator is also described.

23 Claims, 12 Drawing Sheets

FR HYSTERESIS, GRID AT 0 DEG

WIDE-BANDWIDTH POLARIZATION MODULATOR FOR MICROWAVE AND MM-WAVELENGTHS

CROSS REFERENCE TO RELATED APPLICATIONS

This application claims the benefit and priority of U.S. Provisional Application Ser. No. 60/689,740, "Wide Bandwidth Polarization Modulator, Switch, and Variable Attenuator", filed Jun. 9, 2005. The 60/689,740 provisional application is hereby incorporated by reference in its entirety.

FIELD OF THE INVENTION

This invention relates generally to a polarization modulator and more particularly to a wide-band microwave and mm-wavelength polarization modulator, a method for design of a wide-band mm-wavelength polarization modulator, and applications in mm-wavelength polarimetry.

BACKGROUND OF THE INVENTION

Electromagnetic waves, such as microwaves, can have a polarization, such as a linear polarization. The polarization of linearly polarized electromagnetic waves can be characterized by a polarization angle. A polarization modulator operates on these linearly polarized waves to cause a change, or rotation, of the polarization angle. In the prior art, polarization modulation at millimeter-wavelengths (microwave) has been done by physical rotation of mechanical devices, such as by mechanical rotation of a waveguide polarizer, rotation of a wire grid polarizer, or rotation of a birefringent half-wave-plate or mechanical rotation of a dielectric card in a waveguide.

Brian Keating (one of the present inventors) previously designed a polarization modulating device having no moving parts, based on the principles of Faraday rotation. The device was built in a smooth walled waveguide structure and was only capable of operating at specific microwave frequencies (over a very narrow bandwidth). Keating's first Faraday rotation device described above, albeit without moving parts, proved unsuitable for cosmic microwave background ("CMB") polarimeter applications because of the narrow band operation.

Measurements of the polarization of the CMB have the promise to revolutionize our understanding of the early universe. Unlike the temperature anisotropy of the CMB which has been measured to relatively high precision over a wide range of angular scales, the polarization of the CMB has only recently been detected and remains relatively unexplored. Polarimeters potentially useful for such studies have typically employed mechanical mechanisms to modulate the incident CMB radiation field about an optical axis.

In conjunction with an analyzer (to decompose the radiation into orthogonal polarization states), a polarization modulator can be used to exchange the polarized intensity between the two detectors or amplifiers (or to switch the polarization incident on a single detector). If the modulation is done rapidly enough, this technique is useful to mitigate the effects of detector gain instability. Since polarization measurements are often low signal-to-noise, modulation, without such mitigation, gain and offset instability can masquerade as polarization.

It can be advantageous to operate a polarimeter polarization modulator at as high a speed as possible. Prior art mechanical modulators were only capable of modulation rates up to 100 Hz, if that high, as limited for example, by mechanically rotating plates. The problem is that while a modulation frequency of 100 Hz can mitigate the affects of some detector gain and offset variations, it does not help for higher frequency changes in gain and offset, nor is it fast enough to attenuate 1/f noise caused by electronic amplifiers, such as detector and difference amplifiers, used in most polarimeters. Another problem with mechanical polarization modulators of the prior art is that the mechanical vibration from moving elements can introduce a false electrical signal related caused by mechanical vibration.

What is needed is a polarization modulator having no moving mechanical components that can continuously vary an angle of polarization modulation over a wide bandwidth, and that can operate at modulation frequencies over 100 Hz and over a broad band.

SUMMARY OF THE INVENTION

In one aspect, the invention relates to a polarization modulator device for modulating a polarization of an electromagnetic wave includes a corrugated metallic waveguide having an interior cylindrical opening defined therein and situated along a longitudinal axis of the waveguide. The waveguide includes a plurality of corrugations, each corrugation having a tooth and a slot. The corrugated metallic waveguide also has a first waveguide section and a second waveguide section. The waveguide sections are separated by a dielectric break. The dielectric break is defined therein and situated substantially collinearly with the longitudinal axis of the waveguide in substantially a center of the waveguide. A central structure is situated along the longitudinal axis of the waveguide. The central structure includes a cylinder having a permeability greater than 1, and two dielectric cones. The cylinder has two substantially circular end faces situated in perpendicular orientation to a longitudinal axis of the cylinder. Each of the dielectric cones has a base mechanically coupled to an end face of the cylinder and a cone axis situated substantially collinearly with the longitudinal axis of the cylinder. The central structure is supported substantially in the center of the interior cylindrical opening of the waveguide. The cylinder is substantially situated within the dielectric break of the waveguide. A magnetic field source is configured to permit a controllable magnetic field in the cylinder, wherein the magnetic field modulates a polarization of the electromagnetic wave by an angle related to a strength of the magnetic field.

In another embodiment, the waveguide comprises gold plated copper.

In yet another embodiment, the waveguide comprises a superconductor material.

In yet another embodiment, the superconductor material comprises niobium or aluminum.

In yet another embodiment, each tooth and slot of the waveguide forms a right circular cylinder.

In yet another embodiment, the central structure is supported by one or more dielectric supports.

In yet another embodiment, the one or more insulators comprise one or more dielectric supports.

In yet another embodiment, the ceramic cones comprise an alumina ceramic.

In yet another embodiment, the absorber comprises Aluminum Nitride.

In yet another embodiment, the absorber is coated with a microwave absorber.

In yet another embodiment, the magnetic field source comprises a solenoid having solenoid windings.

In yet another embodiment, the solenoid has solenoid windings that comprise a selected one of metallic windings and superconducting windings.

In yet another embodiment, the dielectric cylinder comprises a ceramic or a semiconductor.

In yet another embodiment, the ceramic comprises a ferrite ceramic.

In yet another embodiment, the semiconductor comprises germanium or garnet.

In another aspect, the invention features a method for designing a polarization modulator. The method comprises the steps of providing dimensions for a central structure including overall physical dimensions for a tapered ceramic cone and a dielectric cylinder; providing initial dimensions for a corrugated waveguide structure; modeling with an electromagnetic software analysis package operating on a programmable computer the corrugated waveguide structure with the central structure situated within; and performing iteratively the following steps until a solution having a field distribution and a transmission data versus frequency within predefined tolerances is obtained: operating the model to obtain the field distribution and the transmission data versus frequency; varying the dimensions of the corrugated waveguide structure to change the transmission data versus frequency.

In yet another aspect, the invention provides a polarimeter apparatus for measuring the polarization of an incident electromagnetic wave. The apparatus comprises a receiving structure to guide the incident electromagnetic wave into the polarimeter apparatus; a polarization modulator mechanically coupled to the receiving structure, the polarization modulator including a corrugated waveguide structure having a first and second corrugated waveguide structure sections and a central structure substantially centered within and between the first and second corrugated waveguide structure sections; a magnetic field source magnetically coupled to the polarization modulator, the magnetic field source controllable by an electrical current; an output structure mechanically coupled to the polarization modulator; a detector mechanically coupled to the output structure, the detector generating a detector signal; and an electronic measuring circuit to accept the detector output signal to measure the polarization of the incident electromagnetic wave.

In another embodiment, the electronic measuring circuit includes a lock-in amplifier, and a reference input signal representative of said electrical current and an input signal representative of said detector signal.

In yet another embodiment, the detector comprises a bolometer or an amplifier coupled to a semiconductor detector.

In yet another embodiment, the detector is cooled to a temperature below 100 K.

In yet another embodiment, the magnetic field source is an electrical solenoid.

In yet another embodiment, the electrical solenoid comprises superconducting windings.

In yet another embodiment, the receiving structure is a microwave feedhorn.

In yet another embodiment, the output structure is a microwave feedhorn.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views. For a further understanding of the advantages and objects of the invention, reference will be made to the following detailed description of the invention which is to be read in connection with the accompanying drawing, where:

DETAILED DESCRIPTION OF THE INVENTION

This detailed description is divided into three sections. Part I describes physical embodiments of polarization modulators according to the invention. A method to design a polarization modulator according to the invention is also disclosed. Part II describes various embodiments of polarimeters based on the inventive polarization modulator, and part III presents a theoretical basis for the inventive polarization modulator and for polarimeters based on the inventive polarization modulator for those skilled in the art.

PART I: Wideband Polarization Modulator

Figure 1:
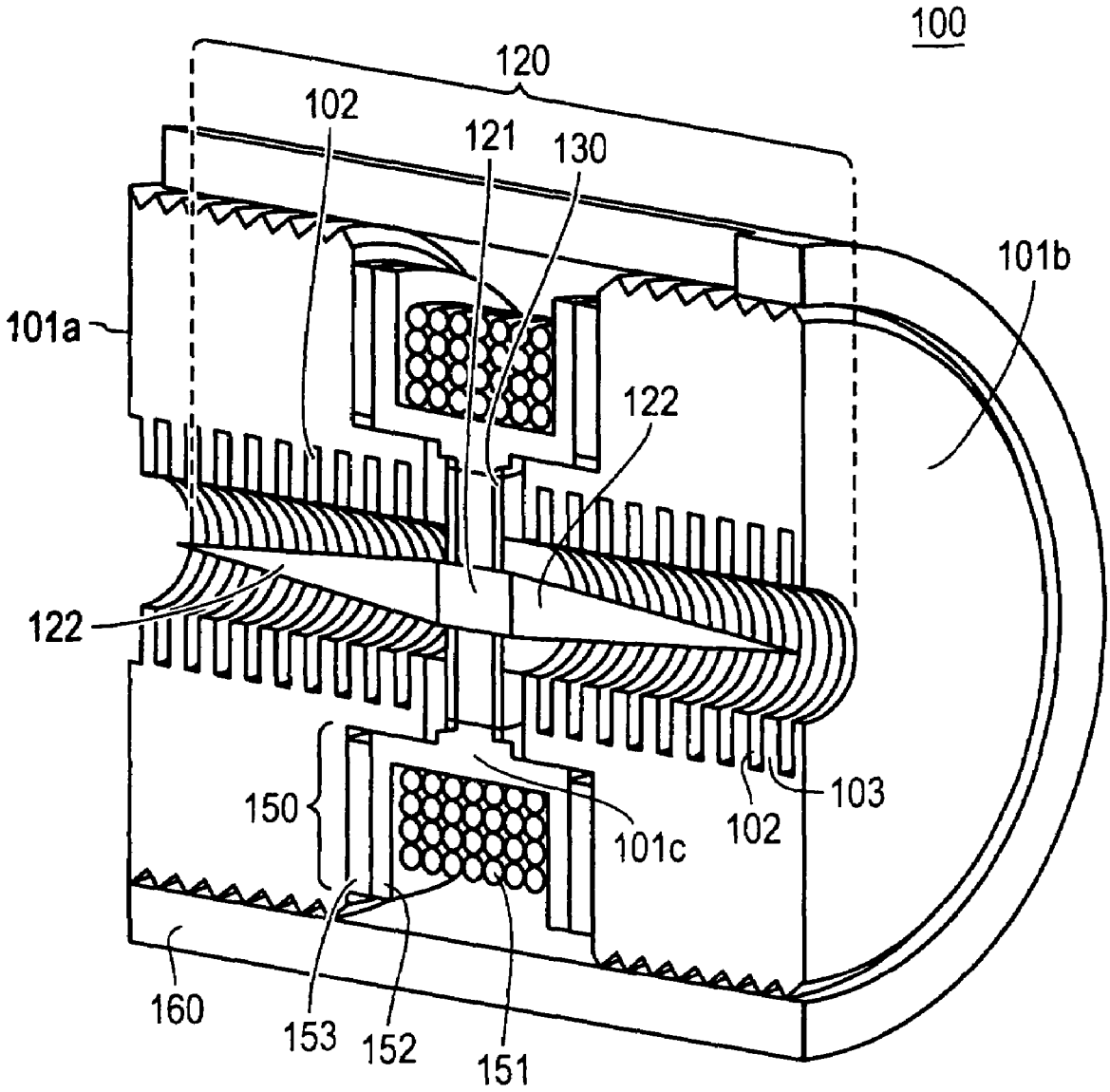
FIG. 1 shows a cut away view of one embodiment of a polarization modulator according to the invention.

FIG. 1 shows a cut away cross sectional view of a polarization modulator 100 according to the invention. The inventive polarization modulator based in part on Faraday rotation and can also be referred to as a Faraday rotation modulator (FRM). A corrugated metallic waveguide comprising corrugated waveguide sections 101*a* and 101*b* can be machined or formed from a metallic material. Corrugated waveguide sections 101*a* and 101*b* include a plurality of slots 102 and teeth 103. Slots 102 and teeth 103 typically form a circular cross section (the teeth and slots are right circular cylinders); however edges, corners, and overall shape can have other geometric forms. Suitable metals for corrugated waveguide sections 101*a* and 101*b* include aluminum, and copper, such as a gold plated electroformed copper. Corrugated waveguide sections 101*a* and 101*b* when made from a metal such as copper will exhibit a finite loss, even at cold temperatures. For ultra low signal level applications, such as some astronomical applications as discussed in Part II where low loss is important, corrugated waveguide sections 101*a* and 101*b* can be fabricated from a superconductor, such as niobium (or intermetallic alloys of niobium, such as niobium-tin or niobium titanium) that can be made superconducting at cryogenic temperatures. Corrugated metallic waveguide sections 101*a* and 101*b* are separated by a dielectric break 101*c*. In most embodiments, corrugated metallic waveguide sections 101*a* and 101*b* can also include end flanges (not shown in the cutaway drawing for simplicity) to mechanically couple the polarization modulator to the flange of an input and/or an output waveguide (not shown).

A central structure 120 (interchangeably referred to herein as a "toothpick") includes cylinder 121 and two ceramic tapered cones 122 mechanically affixed to cylinder 121 for impedance matching to cylinder 121. Cylinder 121 can comprise any dielectric material exhibiting a suitable Faraday rotation at wavelengths of interest, such as mm-microwave wavelengths. Ceramic tapered cones 122 can comprise an alumina ceramic. While the exemplary polarization modulators discussed herein were built and tested using ferrite cylinders, other ceramic and non-ceramic dielectrics are thought to be suitable for use in such devices as well. For example, the Faraday effect has been shown to exist in n type doped germanium. (G. Srivastava and P. Kothari, "*Microwave Faraday effect in n type germanium*", J. Phys. D: Appl. Phys., Vol. 5, 1972, GB). It is contemplated that cylinder 121 can be made from various types of semiconductor materials, including a number of doped garnet semiconductors as manufactured by the Trans-Tech, Inc. of Adamstown, Md.

Toothpick 120 can be held substantially in a center cylindrical opening of corrugated waveguide sections 101*a* and 101*b* by one or more insulating members 130. FIG. 1 shows an embodiment where two insulating members 130 support toothpick 120 inside of the center cylindrical opening of corrugated waveguide sections 101*a* and 101*b* substantially along the central longitudinal waveguide axis. In one embodiment, the insulators can be silica washers. Note that in a preferred embodiment, cylinder 121 is aligned substantially within dielectric break 101*c* between waveguide sections 101*a* and 101*b*.

Cylinder 121 can be subject to a magnetic field of controllable magnetic strength provided by a magnetic source in order to achieve polarization modulation as described later in this section. In the exemplary embodiment show in FIG. 1, solenoid assembly 150 comprises one or more windings 151 to provide such a magnetic source. An electric current from power source not shown can be applied to solenoid assembly 150 through any type of suitable electrical terminals, contacts, or connectors (not shown).

Absorber 152 can absorb stray electric fields that might cause cavity resonance losses or otherwise distort the desired electric field distribution. Ideally the dielectric waveguide would not be surrounded by any metal. However, since it is convenient to use metal in embodiments including a solenoid, an absorbing dielectric prevents the field from penetrating into the coil form and into metal solenoid coil wires 151. The absorber 152 (which is also referred to as a bobbin) can also be made from a non-absorbing, but easily machinable material such as Aluminum Nitride and coated on the inside surface of the bobbin with a microwave absorber such as castable Eccosorb, CR-117, manufactured by Emerson & Cuming Microwave Products, Inc. of Randolph, Mass.

In the present embodiment, yoke 160 and pole pieces 153 create a magnetic shield. In embodiments including solenoid 150, it is advisable to shield solenoid 150 for several reasons. One reason is to prevent the solenoid 150 AC magnetic field from inducing electrical currents into nearby conductors and to avoid eddy currents in nearby conductive structures. Also, as discussed later, polarization modulators can be used independently in array applications involving a plurality of modulators 100 where it can be important to prevent modulators 100 from interacting with each other. In addition, certain types of detectors and amplifiers, such as Transition Edge Superconducting Bolometers and SQUID amplifiers, which can be used with polarization modulators in some applications can be magnetically sensitive and need to be shielded, even from the earth's field, let alone from solenoids 150 in nearby polarization modulators 100, which can be a thousand or more times larger than the Earth's magnetic field. Moreover, coupling can be exacerbated by the AC field from the polarization modulator solenoid 150, as opposed to the earth's DC magnetic field. Because the electromagnetic waves to be modulated need to propagate into and out of modulator 100, the shielding cannot fully enclose polarization modulator 100, i.e., cannot form a complete Faraday cage. However, the combination of yoke 160 (typically a cylindrical shell) and pole pieces 153 (essentially washers which come as close to the waveguide as possible) provide maximum shielding while permitting the entry and exit of signals of interest through input and output signal ports. In low noise cryogenic applications, shielding materials need to be magnetically permeable and to work at low temperatures. One suitable proprietary material, called Cryoperm, manufactured by Vacuumschmelze of Hanau, Germany, can be post production annealed and then fabricated into yoke 160 and pole pieces 153. Post processing annealing of this type can be performed by companies such as the Amuneal Manufacturing Corp. of Philadelphia, Pa. Yoke 160 can include one or more small slots or openings to allow electrical wires from solenoid 150 to pass to the outside for electrical connection to a driving current.

Figure 2:
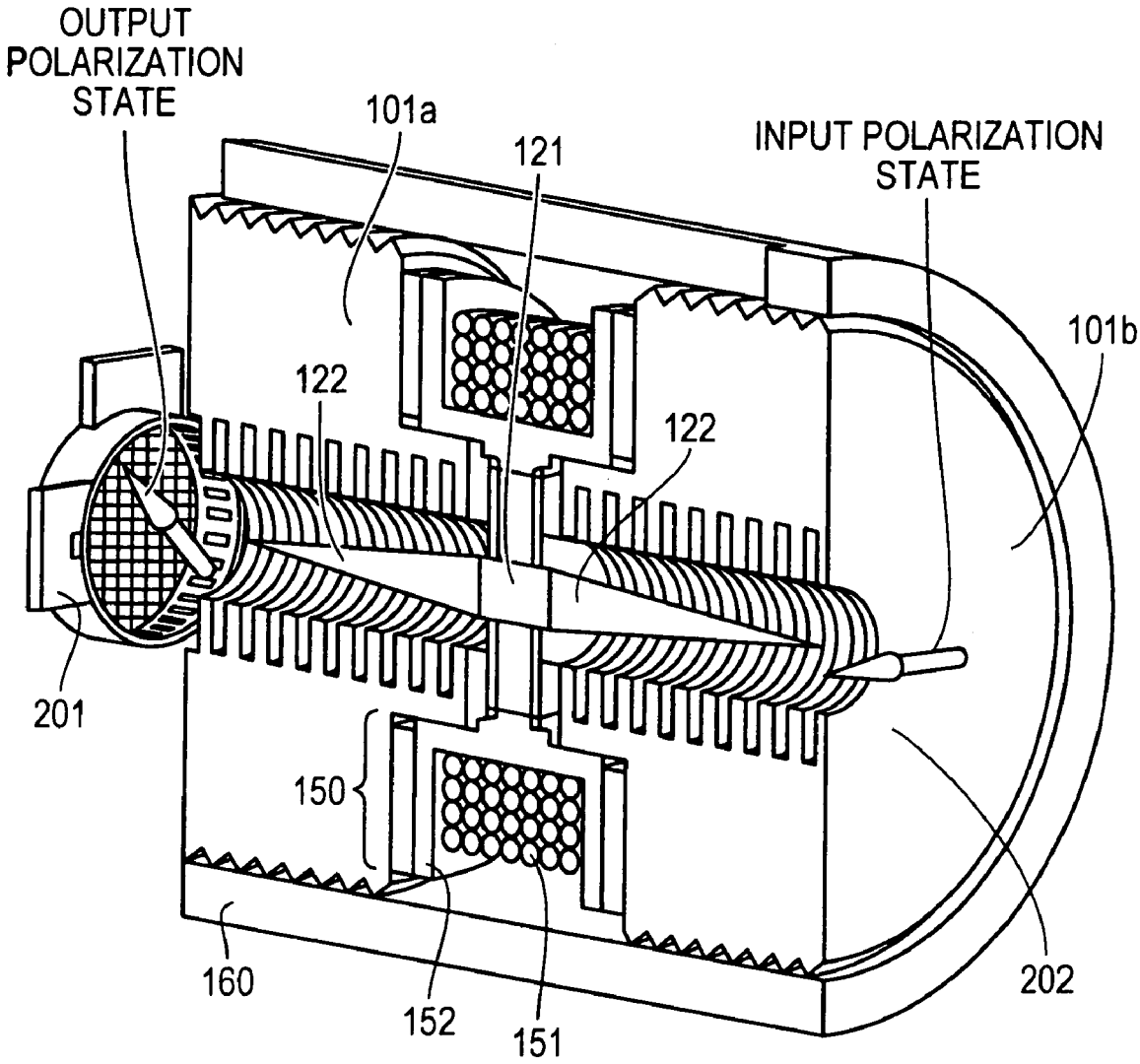
FIG. 2 illustrates an exemplary polarization shifted electromagnetic wave interacting with the device of FIG. 1.

Turning to FIG. 2, the operation of polarization modulator 100 is described. While polarization modulator 100 can be made as a symmetric device as to input and output, for this discussion the input side has been labeled 202. Typically a conventional microwave waveguide, such as a tapered waveguide, having a rectangular to circular waveguide section (not shown), or a horn waveguide section (not shown) or smooth wall circular, rectangular, or square cross section (tapered or not tapered) waveguide (also not shown) can be affixed to one or both sides of polarization modulator 100 using a standard waveguide mounting technique, such as by waveguide flanges (not shown).

In operation, an incoming electromagnetic wave is propagated into a first section of corrugated waveguide section 101*b* and coupled into dielectric cylinder 121 via a first ceramic cone 122. The polarization of the incoming electromagnetic wave can be modulated by a polarization modulation angle as it passes through dielectric cylinder 121 by Faraday polarization rotation according to a magnetic field as caused by the one or more windings 151 of solenoid 150. The electromagnetic wave then continues to propagate out of cylinder 121 via a second ceramic cone 122 and a second section of corrugated waveguide section 101*a*. The output polarized electromagnetic wave can have a final polarization ranging from no polarization change relative to the incoming signal polarization (for example at zero solenoid 150 current) or to a polarization rotation as the result of polarization modulation (non-zero solenoid 150 current). The output signal can be coupled though air out of polarization modulator 100 typically into another waveguide. Note that for linear polarization, integer multiples of $\pi$ rotation are equivalent to no rotation. In FIG. 2, a pair of perpendicularly oriented bolometers 201 detect and measure the output polarization state of the output signal.

An important feature of corrugated waveguide sections 101*a* and 101*b* is that the corrugations preserve the integrity of the polarization of the incoming electromagnetic wave and reduced leakage between polarization states. In prior art smooth wall waveguide designs, the x polarized and y polarized fields would slip with respect to each other. Such slipping gives an undesirable (and undefined) effective polarization rotation. Corrugated waveguide sections 101*a* and 101*b* prevent slip by introducing propagation delay and boundary conditions on the electromagnetic fields such that the x polarized and y polarized fields propagate with the same velocity. Another important feature of corrugated waveguide sections 101*a* and 101*b* is that when designed according to the method described below in this section, the polarization modulator can operate over a broad bandwidth with minimal amplitude ripple across the wide band.

Any suitable magnetic field can be used to cause a polarization modulation angle. The controlling field does not-need to be provided by a solenoid such as solenoid 150 fixed in a cutout along the outside surface of corrugated waveguide sections 101*a* and 101*b* as shown in FIGS. 1 and 2. In various embodiments, the windings 151 can comprise conventional magnet wire, cooled magnet wire (such as a water or liquid cooled conductor), or the magnet windings can comprise superconducting magnet wire to minimize self heating which is particularly advantageous in a cryogenic detector application. The inventive polarization modulator can operate from elevated temperatures through room temperature and down to near zero Kelvin. A limitation on high temperature operation is present when the magnetic permeability of cylinder 121 is substantially reduced so that the designed magnetic field distribution is not attained.

EXAMPLE 1

A preferred embodiment of a polarization modulator 100 according to the invention and optimized for broadband operation in the vicinity of 100 GHz has the following dimensions:

| | |
|---|---|
| Corrugated tooth thickness: | 0.3750 mm |
| Corrugated tooth depth (OD): | 4.58 mm |
| Corrugated tooth (ID): | 2.5 mm |
| Ferrite cylinder: | diameter: 1.17 mm, length: 1.8 mm |
| Alumina cones: | base diameter: 1.17 mm, length: 6.75 mm |

This design can be scaled from 10 GHz-300 GHz and beyond.

EXAMPLE 2

For low noise operation, the magneto-optical design of the modulator can be based on a room temperature isolator employing a ferrite dielectric waveguide and a cryogenic isolator. These isolators can operate in rectangular waveguide allowing precise mode filtration and low spurious mode generation. Operation as a polarization modulator requires matching modal propagation coefficients of the propagating modes in the entrance metallic waveguide ($TE_{10}$, $TE^{\circ}_{11}$, or $HE^{\circ}_{11}$) and the propagating $HE_{11}^{diel}$ mode in the dielectric guide. Successful tests have been performed using a corrugated circular waveguide with a 2.35 mm diameter (for $\lambda$=3 mm for the 100 GHz band, covering a bandwidth-from about 75 GHz to 135 GHz) and 1.5 mm for 150 GHz band ($\lambda$=2 mm) operation (useful over a range of about 135 GHz to 200 GHz).

Efficient coupling of the dielectric hybrid modes was achieved using a corrugated guide. To achieve magnetic saturation with low Joule heating, a solenoid was constructed of superconducting copper niobium wire such as that manufactured by Supercon Inc, Shrewsbury, Mass. 01545. According to Trans-Tech, Inc. of Adamstown, Md., the manufacturer of a ferrite used, ferrite TT2-111 has a saturation magnetization of $4\pi M_z$=5000 gauss which is obtainable with an applied magnetic field of H≃30 Oe. This field was produced by the superconducting solenoid with N~200 amp-turns. The calculated self inductance of the solenoid is $L=\mu_o N^2 A/l$=10 mH where A and l are the area and length of the solenoid, respectively. This value agrees well with the inductance measured with an LCR meter and directly by observing the L/R time constant of the solenoid at 4K. The exemplary polarization modulator design is shown in FIG. 1. All performance attributes of the modulator were improved with careful attention to assembly details and tolerances. In particular, the alumina cone-ferrite cylinder "toothpick" assembly was placed along the propagation direction with less than 1° tilt; otherwise resonant mode conversion can produce several dB of insertion loss and degradation of the useful bandwidth.

Figure 3:
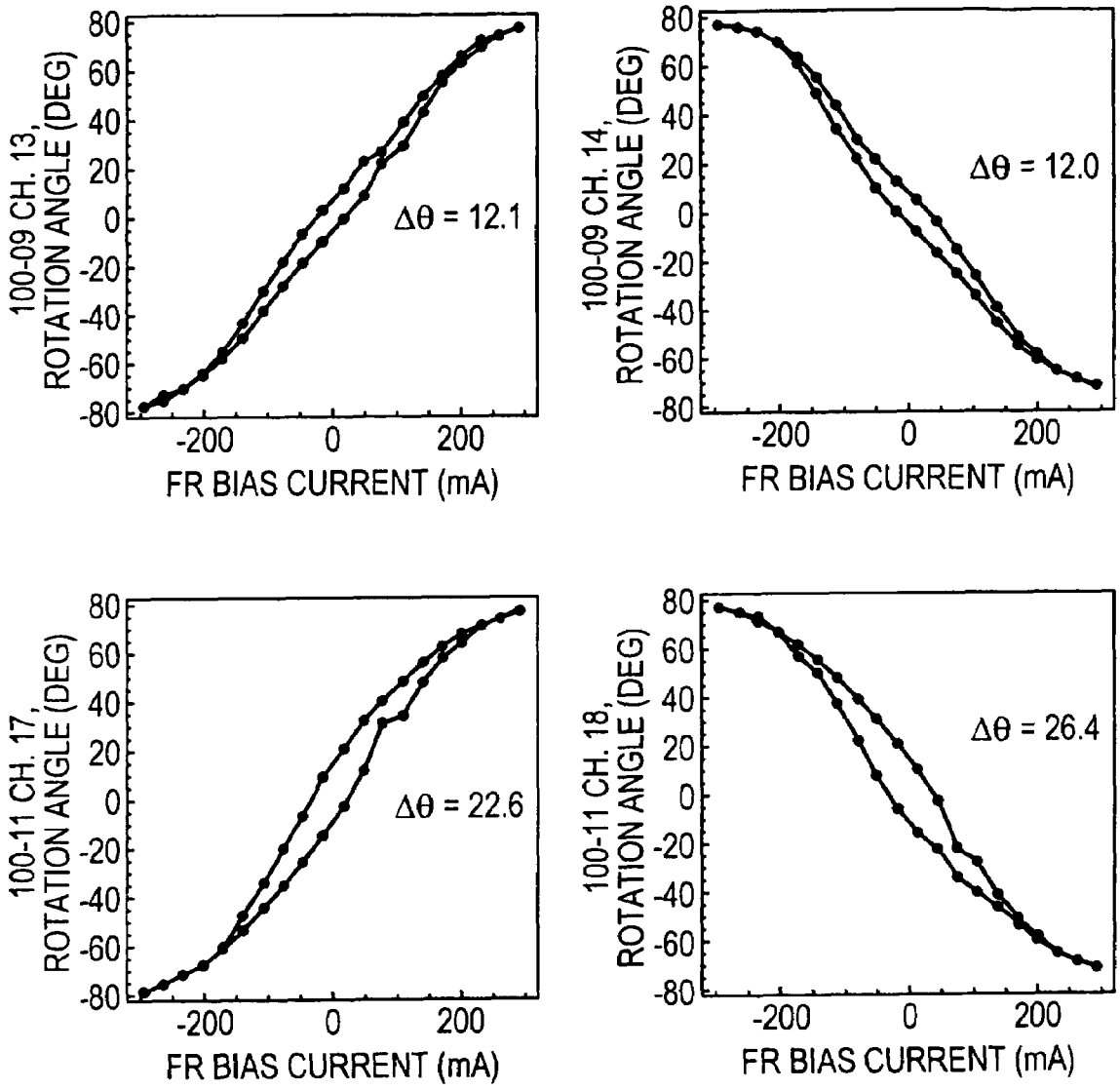
FIG. 3 shows the hysteresis in exemplary polarization modulators.

In embodiments of polarization modulator 100 using a ferrite dielectric cylinder 121, the modulation angle as a function of solenoid 150 current can exhibit hysteresis. FIG. 3 shows the hysteresis in exemplary 100 GHz polarization modulators. In each case, a solenoid 150 current (Faraday rotation modulator "FRM" bias current) was varied from −200 mA to +200 mA. The polarization angle of an incident polarized electromagnetic wave can be seen to vary continuously from approximately −80° to +80°. The gap between the two curves in each of the four graphs is a measure of the amount of hysteresis exhibited by each individual ferrite cylinder and can be seen to have varied in this test from about 12° to 26°. In some embodiments of a polarization modulator 100, dielectric cylinder 121 hysteresis can be used to create a four state system using three levels of current. Or, in other applications, knowledge of the specific hysteresis performance a particular polarization modulator 100 can be used to compensate for the effects of remnant fields in cylinder 121.

A polarization modulator according to the invention can be designed by trial and error in a laboratory setting while observing transmission characteristics while making each physical change to a variable parameter of the structures such as the corrugations of the corrugated waveguide. It is both time consuming and expensive to modify the physical dimensions of a real physical apparatus. In an alternative procedure, a polarization modulator according to the invention can be designed more efficiently by using electromagnetic design software such as High Frequency Structure Simulator, (hereinafter "HFSS"), offered by the Ansoft Corporation of Pittsburgh, Pa. Typically a design begins by defining values for the dimensions of the components of the central structure (toothpick assembly 120) including the dimensions of the two dielectric tapered cones 122 mechanically affixed to cylinder 121. Scalable toothpick dimensions appear above in Example 1. Next the dimensions of the corrugations can be arrived at by iterative simulations starting from a first set of constraints. The parameters that can be varied include: the distance from the ends of corrugated waveguide sections 101*a* and 101*b* from the center of the toothpick 120, the thickness, period, and depth of the teeth that form the corrugated structure. Then, using a program such as HFSS the transmission versus frequency is optimized by tuning the various physical parameters. Transmission should be as flat as possible in a range of frequency, for example, over a range of 70 to 150 GHz. In summary, a simulation can be performed with a given toothpick dimensional specification and initial set of corrugated waveguide physical parameters and then the design is optimized for the highest possible transmission and minimal ripple. A transmission function with as near to a flat top performance as possible is desirable. One can then make a physical device according to the calculated parameters.

Figure 4:
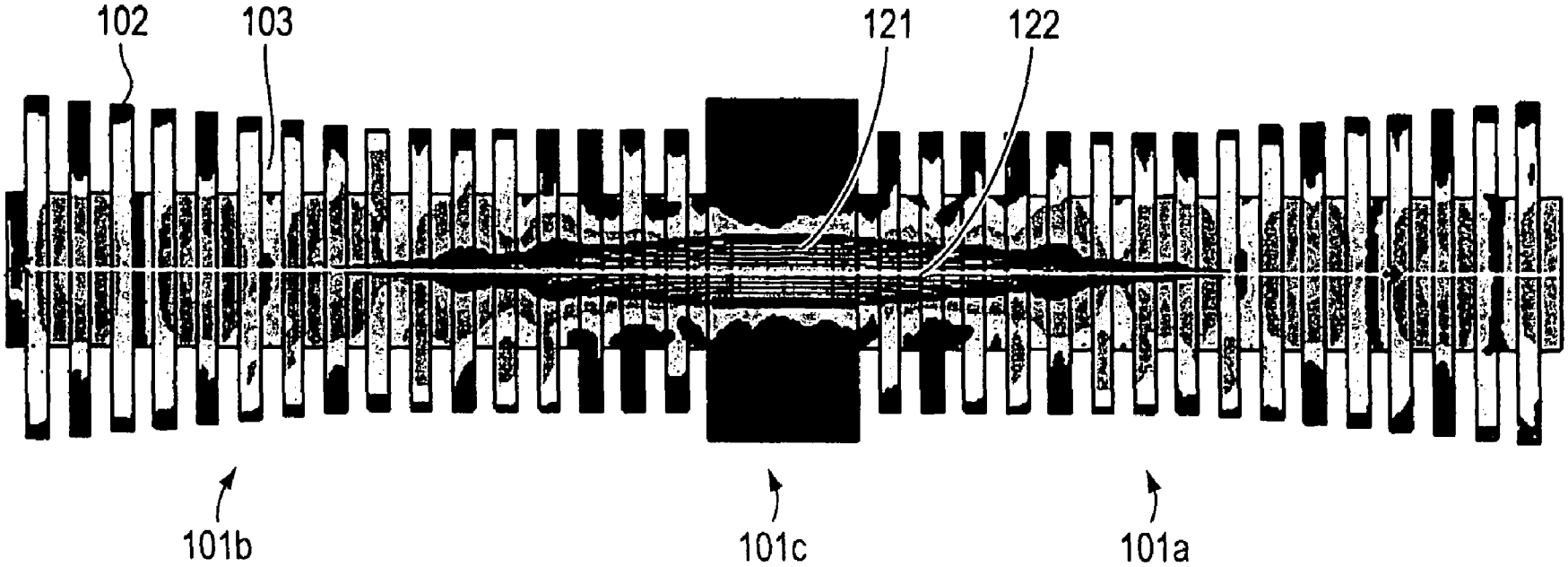
FIG. 4 shows an exemplary HFSS field strength distribution.

FIG. 4 shows an exemplary HFSS field distribution inside a simulation of polarization modulator 100. HFSS was used to vary the diameter of the ferrite such that most of the field is contained inside the cylinder 121 (a ferrite). Only electric field power inside of ferrite cylinder 121 is rotated. Therefore, any stray field that exists outside the ferrite can reduce the transmitted field and degrade polarization modulation efficiency, however, there is no way to completely reduce or eliminate the fields outside the ferrite. In the limit, where the inner surface of the absorber (formed by the coil-form or bobbin) is infinitely far from the axis of the ferrite, all of the electric field is confined in the ferrite and all of the electric field is transmitted and rotated properly (100% polarization rotation efficiency). However 100% polarization rotation efficiency is generally not possible, because ferrite cylinder 121 is typically surrounded by a coil to provide magnetic bias to cause the polarization rotation (polarization modulation). Note that the field can decay rapidly as the coil form's inside diameter is increased. Part of the optimization can include how far the coil form should be from the ferrite. To simulate a boundary infinitely far away, the coil form can be simulated as absorbing. Thus, any field that does not propagate through the ferrite is absorbed by the coil form and not reflected.

Figure 5:
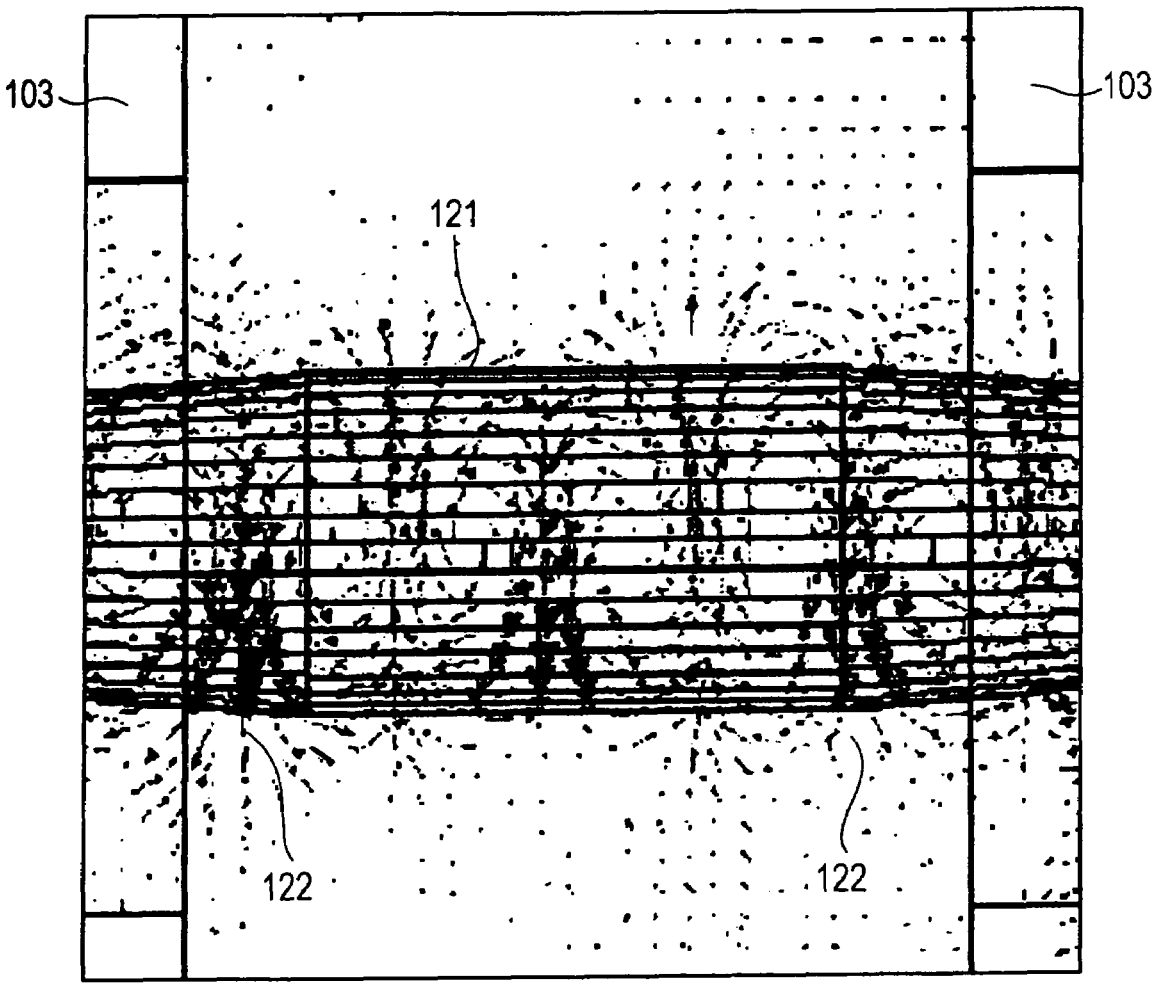
FIG. 5 shows an exemplary HFSS field direction distribution.

FIG. 5 shows exemplary field vectors for a polarization modulator 100 HFSS simulation (as compared to field strength shown in FIG. 4). A single tooth 103 nearest cylinder 121 is shown on each side of the figure. The electric field lines do not penetrate the metal teeth, as expected from electromagnetic theory. Also, the field at the surface of each tooth is normal to the tooth, as expected from electromagnetic theory. Also, most of the electric field is shown as confined to the ferrite, as desired. While, ideally there would be no field outside of the ferrite, in simulation, it has been found that over 95% of the field can be contained in the ferrite.

EXAMPLE 3

Figure 6:
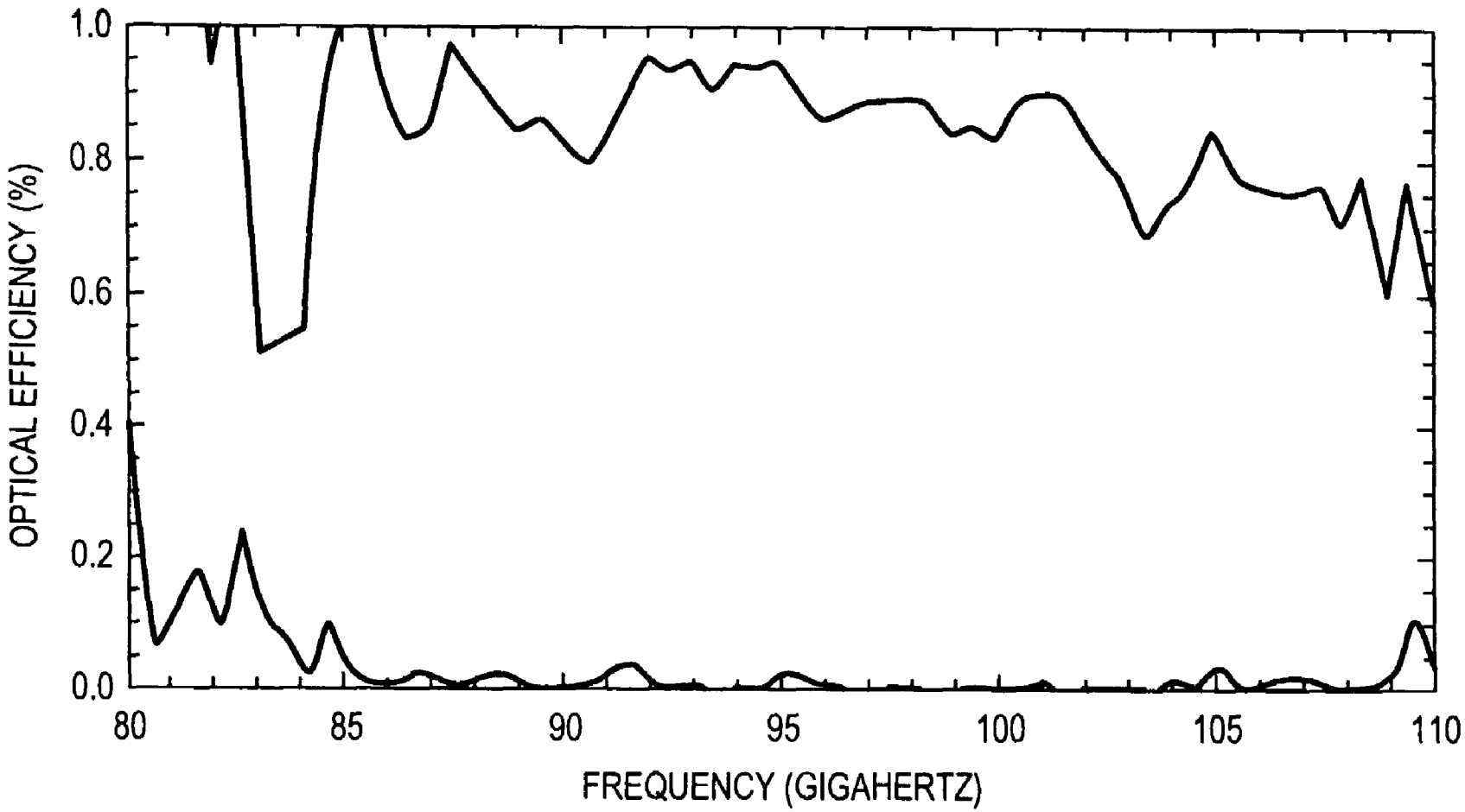
FIG. 6 shows a graph of optical efficiency (transmission) measurements for an exemplary device.

A polarization modulator was constructed for use with polarization sensitive bolometers over the frequency range 80 to 110 GHz. The insertion and reflection loss of the rotator versus frequency was measured at room temperature on a vector network analyzer ("VNA"). Rectangular-to-circular waveguide transitions were used to couple power from the VNA to the waveguide ports of the FRM. Excellent agreement was found between the measured operating parameters of the real device and simulated parameters using HFSS. FIG. 6 shows optical efficiency (transmission) measurements of an actual device. The performance characteristics of the 100 GHz polarization modulator at room temperature (300 K) were measured using a vector network analyzer. The average microwave transmission efficiency of the rotator was found to be 80% and the band-averaged reflection loss was less than 1% across a 27 GHz band (28% fractional bandwidth). Average transmission increases by 1 to 2% after cooling below 10 K. The minor reflection feature (lower trace) at 83 GHz is due to the high pass cutoff frequency of the corrugated waveguide design of this particular modulator. Similar devices operating from 130-215 GHz have been produced, and approximately 20 devices have been cooled to 4.2 K and successfully used as polarization modulators. Room temperature receivers (typically comprising an amplifier and microwave detector) such as scalar and vector analyzers as those manufactured by the Agilent Corporation of Palo Alto, Calif.

EXAMPLE 4

Exemplary measured properties of 100 and 150 GHz polarization modulators (Faraday rotation modulators) have been measured as: ("warm" is used interchangeably herein with "room temperature")

Absolute RF transmission at room temperatures (warm) 65-80%
RF reflection (warm)<3%
Current required for ±45° rotation ±130 mA Power dissipation (4 K) 1 mW
Polarization modulation efficiency (4.2 K) 99%
Intrinsic instrumental polarization (4.2 K)<2%
Cross-polarization (4.2 K)<1%
Depolarization (4.2 K)<1%

Figure 7:
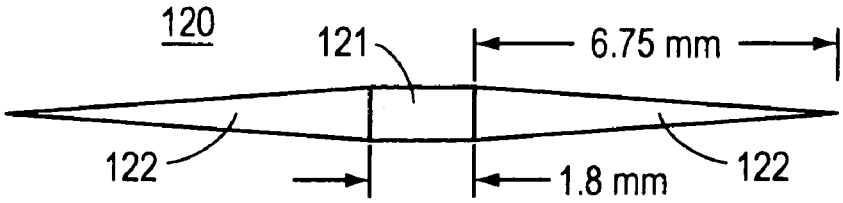
FIG. 7 shows a central structure including dielectric cones and a dielectric cylinder.
Figure 8A:
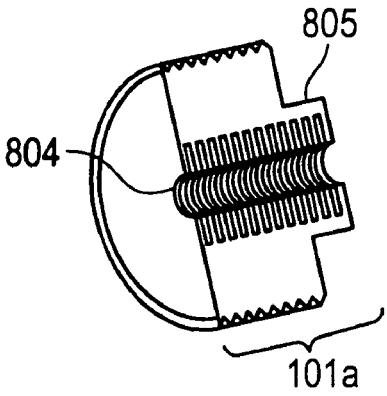
FIG. 8A shows a section of corrugated waveguide.
Figure 8B:
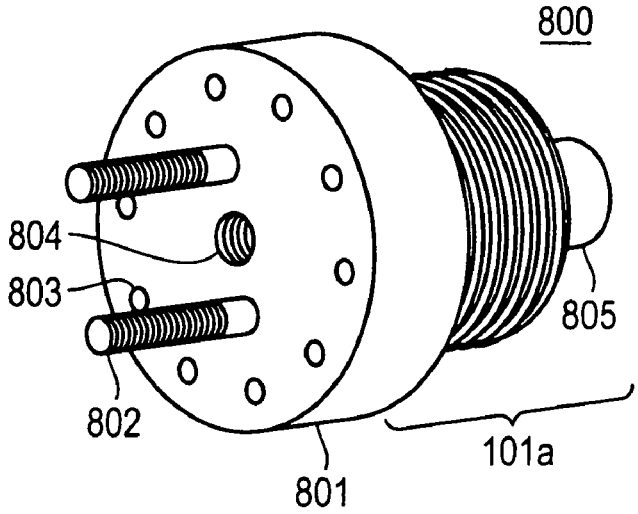
FIG. 8B shows an embodiment of a section of corrugated waveguide having a waveguide flange.
Figure 9:
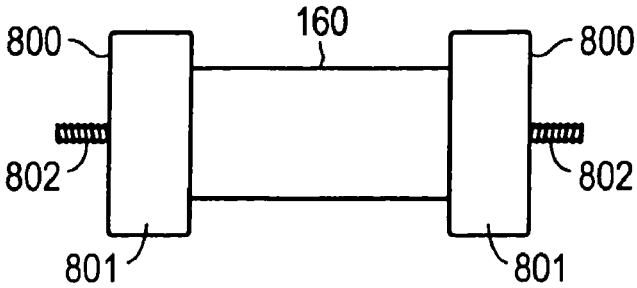
FIG. 9 shows an exemplary polarization modulator using the flanged waveguide section of FIG. 8B.

FIG. 7 shows a black and white rendition of a toothpick 120 having in this exemplary embodiment, alumina ceramic cones 122 and a ferrite cylinder 121. Note that the edges of cones 122 are actually smooth and that any apparent irregularities are an artifact of the FIG. 7 rendition. Part of the optimization process to maximize transmission, particularly where the dielectric constant of cones 122 is different than the dielectric constant of cylinder 121, can include a determination of the optimum ratio of cone 122 base diameter to the ferrite cylindrical 121 diameter. This ratio can be used to improve the impedance match into cylinder 121. For example, where the dielectric constant of cylinder 121 is greater than the dielectric constant of cone 122, cone 122 base diameter can typically be less than the diameter of cylinder 121. FIG. 8A shows corrugated waveguide section 101*a* from FIG. 1. FIG. 8B is a sketch showing how in one embodiment, the structure shown in FIG. 8A can be made to include flange 801. Narrowed section 805 of corrugated waveguide section 101*a* and waveguide entrance 804 are shown to help understand this embodiment 800. In various embodiments, flange 801 can further include threaded mounting holes 803 and/or threaded studs 802 for conveniently mating section 800 to another waveguide component flange, such as a flange on a microwave feedhorn (not shown). FIG. 9 is a sketch of a complete polarization modulator 100 using two corrugated waveguide sections 800 and a yoke 160 from FIG. 1 (visible as the central section).

PART II: Polarimetry Applications

Figure 10:
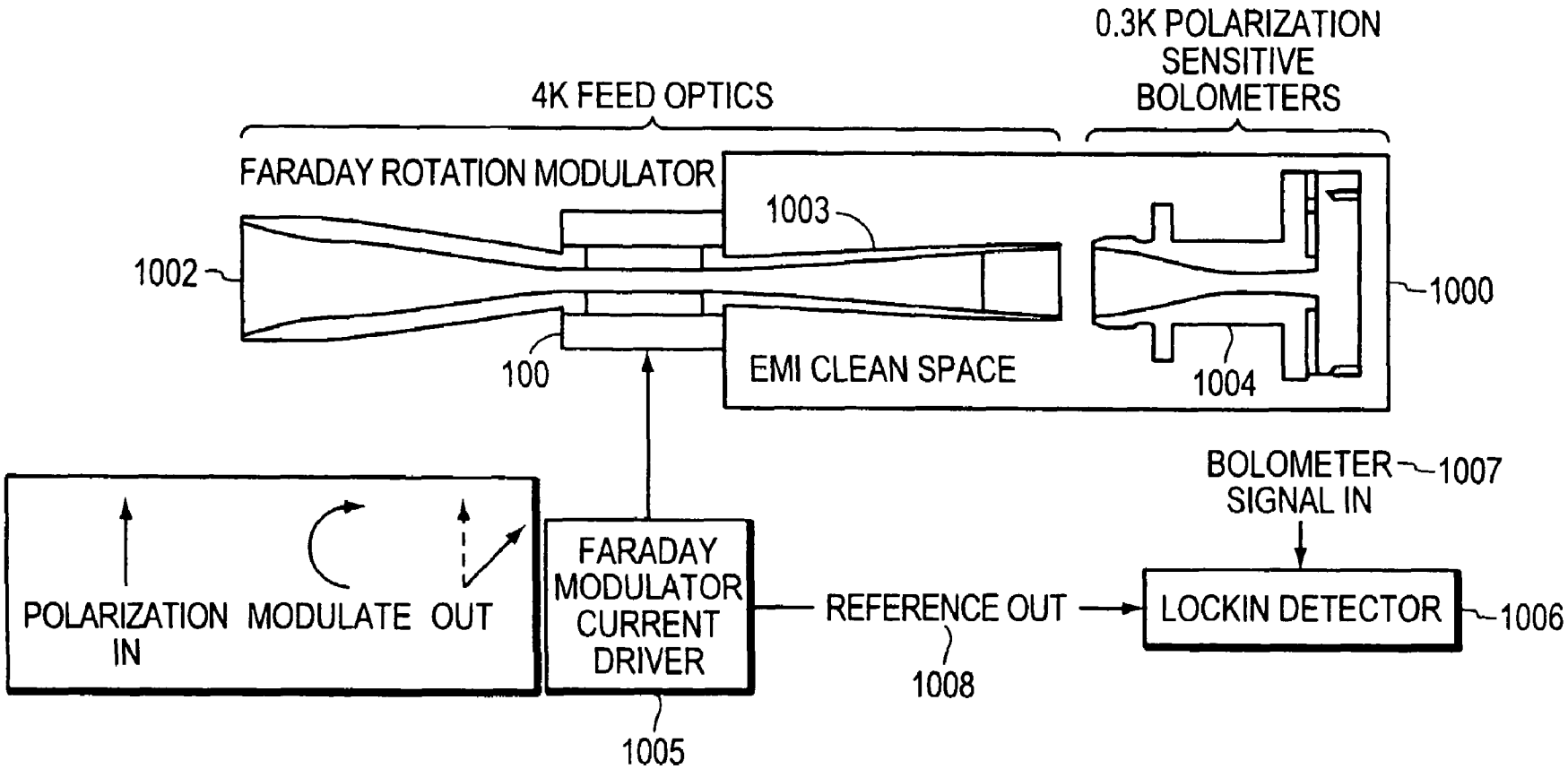
FIG. 10 shows a block diagram of one embodiment of a polarization modulator.

FIG. 10 shows an embodiment of an inventive polarimeter 1000 using a polarization modulator 100. A back-to-back corrugated feedhorn geometry allows for a thermal break between the beam defining optics (typically cooled to 4.2 K) and bolometer detectors (typically cooled to 0.25 K). Also, the throat section region affords the ability to affect electromagnetic interference ("EMI") shielding. In one embodiment, the EMI shield can be implemented as a high-pass filter (waveguide choke) between the two back-to-back feedhorns in the beam-defining optics section, to prevent radio frequency radiation from being detected by the high-impedance bolometers. The waveguide choke allows a single waveguide mode to propagate. Polarization modulator 100 can be installed at the waveguide throat.

In a typical mm-wavelength polarimeter application, polarized electromagnetic waves are received though feed horn 1002 as shown in FIG. 10. The polarized electromagnetic waves having an initial polarization are then coupled into and out of polarization modulator 100 to feedhorn 1003. Both feedhorns can be of types similar to those offered by Custom Microwave Inc. of Longmont, Colo. In the polarimeter embodiment of FIG. 10, the detector is a polarization sensitive bolometer. Other types of detectors, such as various types of microwave amplifiers coupled to semiconductor detectors, such as silicon detectors (not shown), can be used as well. Generally in embodiments used in astronomical applications both the polarization modulator and the detectors are cooled, often to cryogenic temperatures, in order to lower thermally generated noise. In other applications, especially where silicon detectors are used, the entire polarimeter can be operated at room temperatures, albeit with a far higher noise floor. Cryogenic temperatures are defined herein as <100 K, however, in astronomical applications, polarimeter components, including polarization modulators (with superconducting solenoid windings and/or superconducting waveguides) and detectors, are typically cooled to <4 K.

The polarization angle impressed on the incident mm-wavelength electromagnetic signal by polarization modulator 100 is determined by a Faraday modulator current driver 1005. Typically a sine wave modulation is used. The frequency of such modulation can vary from Hz to above 100 KHz. An important feature of a polarization modulator 100 is that it can be operated at far higher modulation frequencies than previous available in polarization modulating devices. Operating at higher modulation frequencies can be important for mitigating various sources of lower frequency noise within the polarimeter, particularly 1/f noise (shot noise) contributed largely from transistors in solid state amplifiers as previously discussed.

Detection after modulation can be accomplished with a bolometric or HEMT amplifier radiometer. For the latter application, the rapid modulation frequencies available with the Faraday rotator (polarization modulator 100) allow the radiometer to be Dicke-switched in total power mode, i.e. without phase modulation. When use in astronomical applications, with either a HEMT amplifier or bolometer, the inventive polarimeter can completely characterize the linear polarization state of the incident radiation from the same spatial pixel in the focal plane of a telescope, through the same optical train (windows, lenses, filters, detectors), under identical optical loading conditions.

A lock-in amplifier, such as a model SR830 manufactured by Stanford Research Systems of Sunnyvale, Calif., is able to detect and make highly accurate measurements of extremely weak signals using phase sensitive demodulation. In operation, according to the embodiment of polarimeter 1000 as shown in FIG. 10, the electrical modulation signal from Faraday modulator current driver 1005 is applied to polarization modulator 100 as a modulating solenoid current whereby polarization modulator 100 can be operated in a continuous modulation mode over a continuous modulation range. The electrical modulation signal can also be applied to the "reference" input of lock-in amplifier 1006, typically as a voltage waveform (shown as reference output 1008, in FIG. 10). In one embodiment as shown, the lock-in amplifier 1006 input signal is provided by as bolometer signal 10607 from bolometer sensor 1004. Lock-in amplifier 1006 performs a multiplication of the reference signal and the detector signal and integration, the resultant measurement yielding a polarization measurement of the incident electromagnetic wave. The theoretical basis for this measurement is explained in further detail in part III.

There are many applications where it can be advantageous to form an array of polarimeters. Each polarimeter having its own internal polarization modulator in an array of polarimeters can be compared by analogy to a pixel detector in an optical imager, such as a CCD imager. As was previously discussed in the modulator section of Part I, shielding helps to guard each polarization modulator and especially each sensitive detector from each other. Suppression of such "cross talk" is essential for producing accurate array data. An array of 25 100 GHz FRMs and 24 150 GHz band FRMs has been constructed.

PART III: Theoretical Basis and Testing

Although the theoretical description given herein is thought to be correct, the operation of the devices described and claimed herein does not depend upon the accuracy or validity of the theoretical description. That is, later theoretical developments that may explain the observed results on a basis different from the theory presented herein will not detract from the inventions described herein.

A pair of polarization sensitive bolometers ("PSB"s) can be used in polarimetry applications to simultaneously analyze (separate the incident beam into orthogonal polarization states) and to detect the power in each state. For an incident electric field described by:

$$\vec{E}(x, y, z, t) = E_x(t)\sin\left[2\pi\left(\frac{z}{\lambda} - \nu t\right) + \phi_x(t)\right]\hat{x} + E_y(t)\sin\left[2\pi\left(\frac{z}{\lambda} - \nu t\right) + \phi_y(t)\right]\hat{y}, \quad (1)$$

time-averaging over the electric field oscillations, the Stokes parameters of this field are defined as:

$$I \equiv \langle E_x^2\rangle + \langle E_y^2\rangle, \quad (2)$$

$$Q \equiv \langle E_x^2\rangle - \langle E_y^2\rangle, \quad (3)$$

$$U \equiv \langle 2E_xE_y\cos(\phi_x - \phi_y)\rangle, \quad (4)$$

$$V \equiv \langle 2E_xE_y\sin(\phi_x - \phi_y)\rangle, \quad (5)$$

where I is the intensity, Q and U describe the linear polarization, and V quantifies the circular polarization of the electric field.

One astronomical application of such a polarimeter is for viewing cosmic microwave background ("CMB") radiation. CMB is linearly polarized so V=0. If the source is a blackbody radiator in the Rayleigh-Jeans portion of the spectrum, then the observed Stokes parameters are $I \propto (T_x + T_y)$, $Q \propto (T_x - T_y)$ with the proportionality constants fixed by calibrating the receiver system. The signal produced by differencing the two linear polarization-sensitive bolometers when the microwave signal is Faraday modulated is:

$$V_{diff} = S \times \eta_{opt}\eta_{pol}[Q\cos 2\theta(t) + U\sin 2\theta(t)] \quad (6)$$

where the (time dependent) modulation angle is $$\theta(t) = B_z(t)\gamma l\sqrt{\epsilon}/2c, \quad (7)$$

l, $\epsilon$, $\gamma$, and S are the ferrite's length and dielectric constant ($\simeq$12), the gyromagnetic ratio of the electron, and the bolometric sensitivity in V/W, respectively. $B_z(t) = H_z^{app}(t) + 4\pi M_z(t)$ is the (time-dependent) magnetic induction.

Polarization modulator rotation angles were determined using a polarization grid. In other alternative test setups it is believed that one can use alternative polarization sources such as a dielectric sheet, Gunn Oscillator (narrowband source) or a noise generator (broad band source). These could all be used as calibration sources. In these tests, continuous polarization modulation was performed over a 160° range.

To determine the rotation angle, the maximum and minimum detector output voltages were determined. Since the PSBs are absorbing polarization analyzers, a maximum voltage is produced when the wire-grid axis is oriented perpendicular to the bolometer's sensitivity axis. The bolometer's voltage is minimized when the grid azimuthal angle is rotated by 90° from the maximum. If the grid is positioned midway between the two bolometers, then the polarization rotation angle is given in terms of the bolometer output voltage by:

$$\theta = \frac{1}{2}\arcsin\left(\frac{V-(V_{\max}+V_{\min})/2}{(V_{\max}-V_{\min})/2}\right). \tag{8}$$

When polarization modulators 100 are used in a continuous modulation mode, it can be seen from equations 3 and 4 that when the electric field produced by a grid is at 45° to each bolometer, Q=0 and U is maximized. If the polarization modulator is then driven into saturation to rotate the polarization angle by +45°, the Stokes parameters (in antenna temperature units) will be Q=223 K and U=0 K.

If the current is sinusoidally varied up to the current required for magnetic saturation: $I=I_{sat}\sin\omega t$, the rotation angle will be $\theta(t)=\Theta_o\sin\omega t$ where $\Theta_o=M_{sat}\gamma l\sqrt{\epsilon}/2c$ is in radians, and the difference between the (orthogonally polarized) bolometer signals $V_{x,y}$ is:

$$\Delta V(t) = V_x - V_y$$

$$\propto \cos^2\left(\frac{\pi}{4}-\theta_o\sin\omega t\right)-\cos^2\left(\frac{\pi}{4}+\theta_o\sin\omega t\right) \tag{9}$$

$$= \sin(2\theta_o\sin\omega t). \tag{10}$$

Phase sensitive demodulation of $\Delta V(t)$ at the current bias frequency, ω, produces a signal:

$$S = \int_0^{\pi}\Delta V(t)\sin\omega t\,dt \tag{11}$$

$$= \int_0^{\pi}-\sin(2\theta_o\sin\omega t)\sin\omega t\,dt$$

$$= gJ_1(2\theta_o)$$

where $J_1(x)$ is the first-order Bessel function and g accounts for the gain of the lock-in (and numerical factors). S is maximized when $\Theta_o=52.7°$. Since $\Delta V(t)$ is not a pure sinusoidal signal, higher (odd) harmonics are also present, decreasing as $J_n(2\Theta_o)$.

Figure 12:
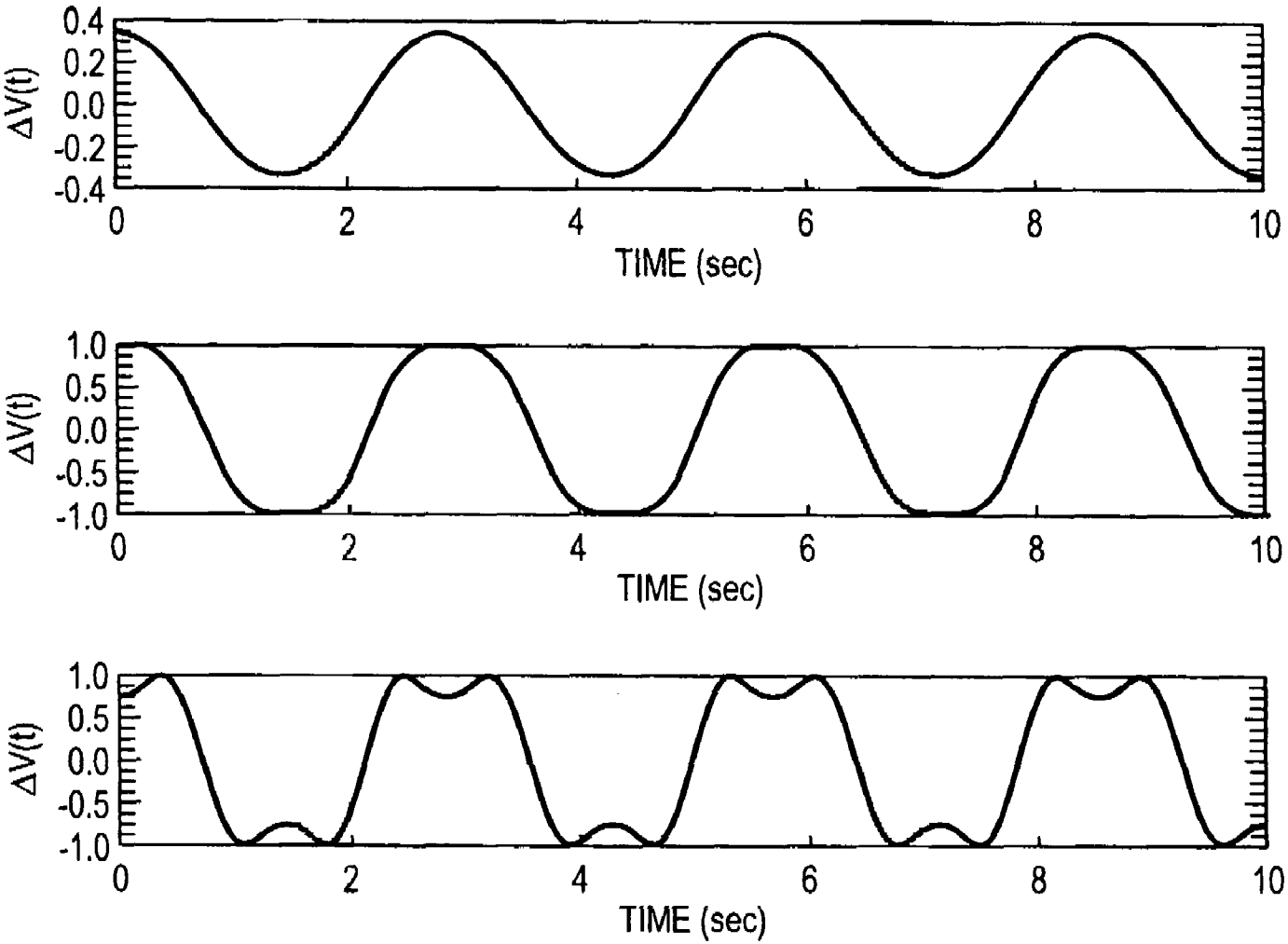
FIG. 12 shows exemplary difference signals of equation 10 for various values of magnetic bias current.

FIG. 12 shows simulated difference signals (Equation 10) for orthogonally polarized bolometers viewing a polarized source whose polarization plane is rotated using a Faraday modulator. The bias modulation waveform for all curves was a 2.2 Hz sinusoid with current amplitude set to rotate the linear polarization by 10° (top), 45° (middle), and 65° (bottom).

It can also be seen that taking the difference of the bolometers' signals is a measure of the value of the Stokes Q parameter (in the coordinate system fixed to the bolometers). As the grid rotates the difference signal varies exactly as in equation 6, with θ(t) equal to the azimuthal angle of the grid about the optical axis. This measurement describes the detection of linearly polarized radiation with 100% polarization modulation efficiency (in the sense that no other modulator can produce a larger differential signal).

Figure 11:
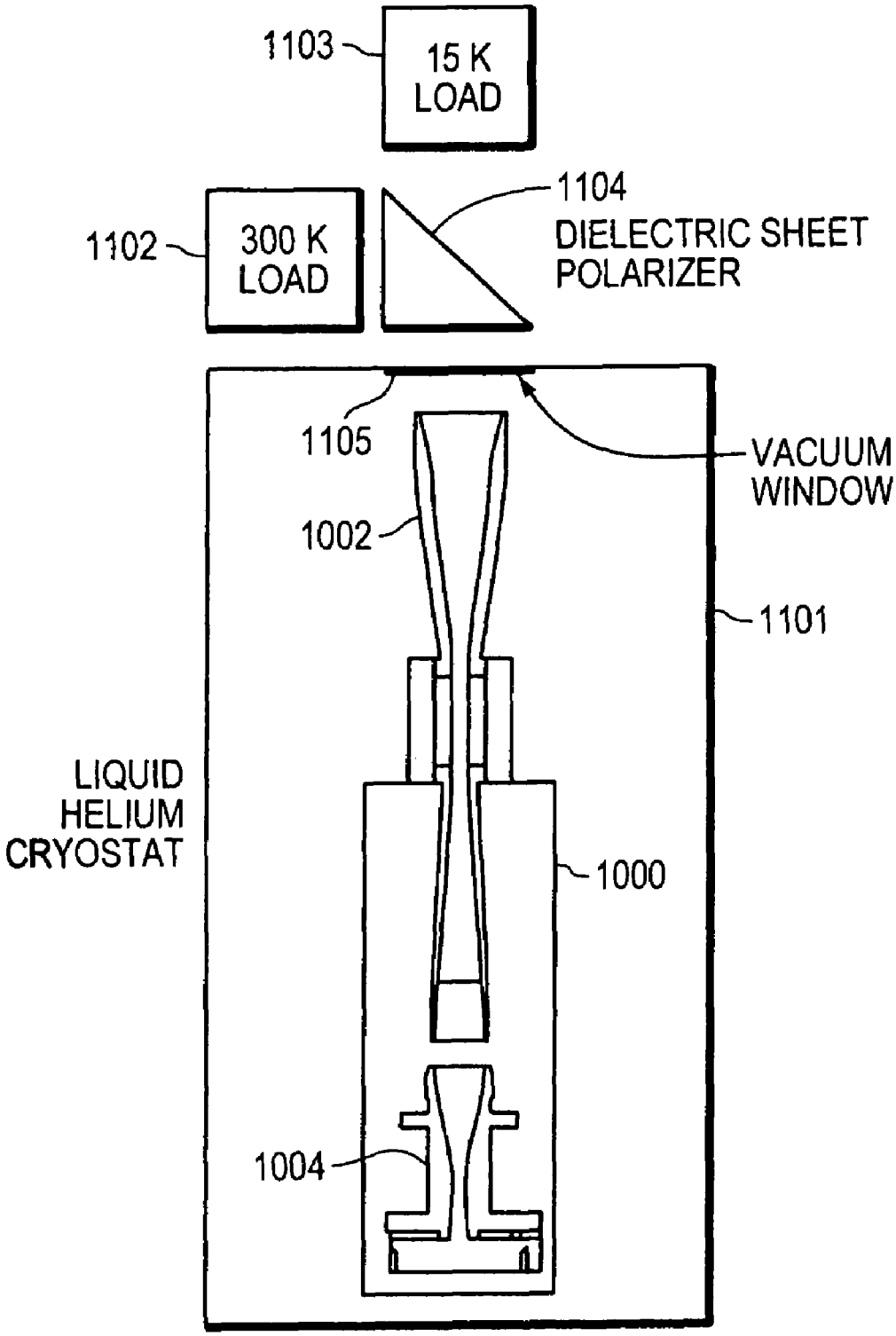
FIG. 11 shows a bolometric test receiver and a configuration useful for calibration.

FIG. 11 shows an 80-100 GHz bolometric test receiver that was constructed for testing and measuring polarization modulation performance to determine the Faraday rotation modulator's (FRM) suitability for use as a polarization modulator. The receiver assembly 1000 comprised a corrugated feedhorn 1002 to couple the electromagnetic radiation into the FRM and feedhorn 1003 to couple the electromagnetic radiation out of the FRM, polarization modulator 100 and polarization sensitive bolometers 1004 operating at 0.3 K, as shown in FIG. 10. The bolometers 1004 were calibrated using unpolarized thermal loads and the receiver was configured to view a partially polarized source produced by a dielectric sheet 1104 polarizer and a 300 K load 1102 reflected from the sheet 1104 and 15 K load transmitted 1103 through the sheet. This source presents a few-percent, partially polarized signal with an antenna temperature of approximately 20 K into the receiver which was subsequently modulated by the polarization modulator 100. In order to measure the instrumental polarization, the dielectric sheet polarizer was removed and the receiver viewed the 15 K load (the sky) directly.

Figure 14:
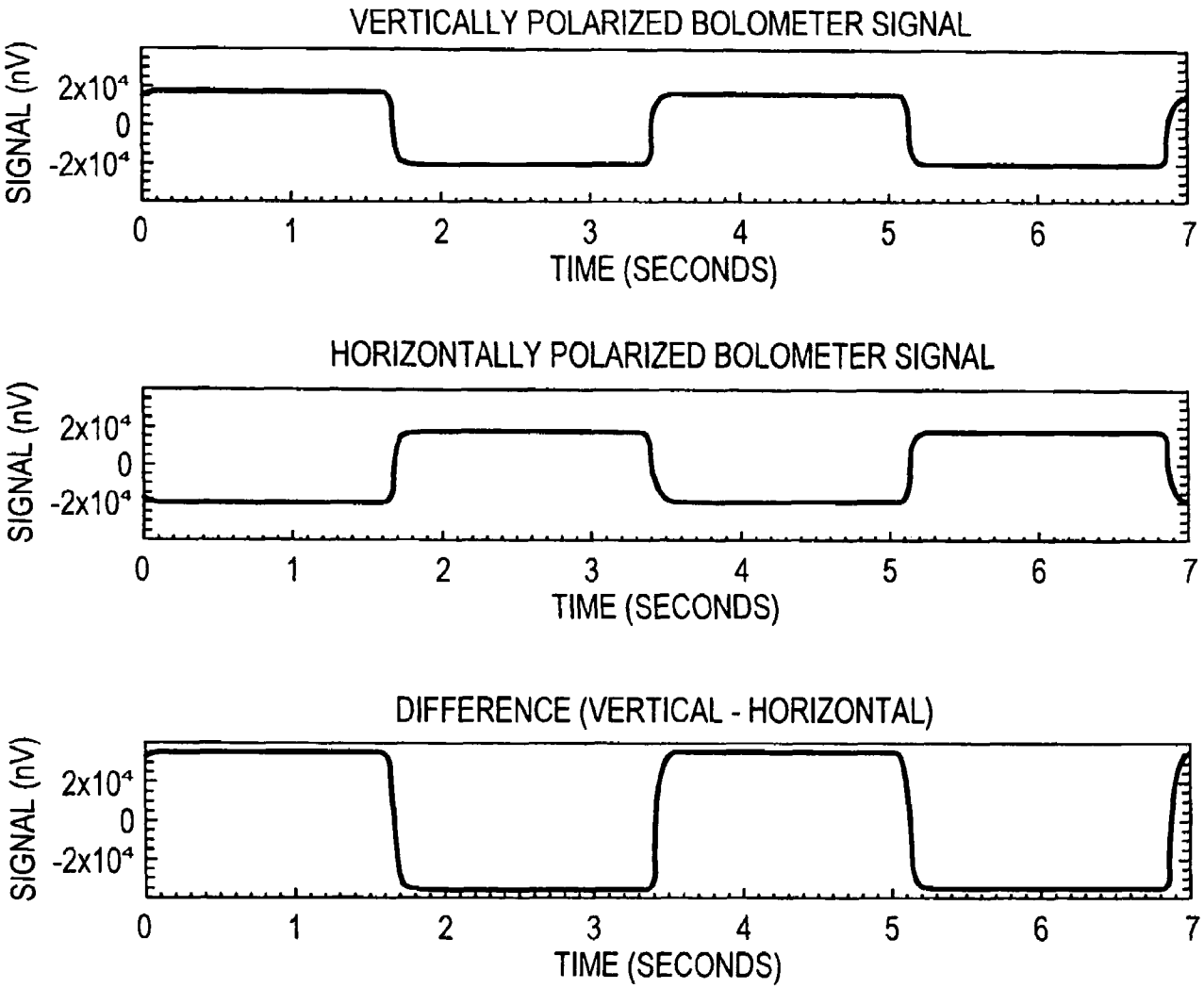
FIG. 14 shows an exemplary calibration result for one embodiment of bolometric detectors used with an FRM.

FIG. 14 shows the result of calibrating the bolometric detectors used with one embodiment of an FRM while viewing a partially polarized source with a thermodynamic temperature of approximately 20 K.

A dielectric sheet polarizer tilted at 45° to the optical axis was used to reflect blackbody radiation from a 300 K load and transmit radiation from a 15 K load as shown in FIG. 11. Two polarization sensitive bolometers view a 100% polarized thermal load with an antenna temperature of 20 K. A polarization modulator was biased to provide 45° of rotation. The top graph shows the signal from the fore-PSB, the middle graph shows the signal from the aft-PSB, and the bottom graph shows the difference between the fore and aft bolometers, which is a measure of the Stokes Q parameter. The modulation efficiency was >95%. If the polarization efficiency were 100% and the modulator were lossless and set to rotate 45°, then the maximum value of a difference curve would correspond to that produced by a 20 K load. This would equal the maximum signal produced by the radiometer without the polarization modulator when the polarizing grid is rotated about the optical axis.

Polarization Fidelity: Three primary systematic effects can corrupt polarimetry: instrumental polarization, cross-polarization, and depolarization. Instrumental polarization (IP) results from spurious coupling of the polarimeter (modulator, analyzer, and detectors) to unpolarized radiation. The IP for the bolometric receiver shown in FIG. 11 (with the polarizing grid removed) was determined by observing the unpolarized atmosphere at the geographic South Pole (approximately a 15 K load) and measuring the bolometer difference signals produced as the Faraday modulator was square-wave biased at ~1 Hz. If there is non-zero instrumental polarization produced by either the optical system and/or the polarization modulator, the two orthogonal bolometer signals will be 180° out of phase and the amplitude of the bolometer signals will scale with the load temperature. The sum of optical and electrical (cross-talk) IP contributions of the polarimeter was found to be <2% for a sample of ~20 polarization modulators.

Figure 13:
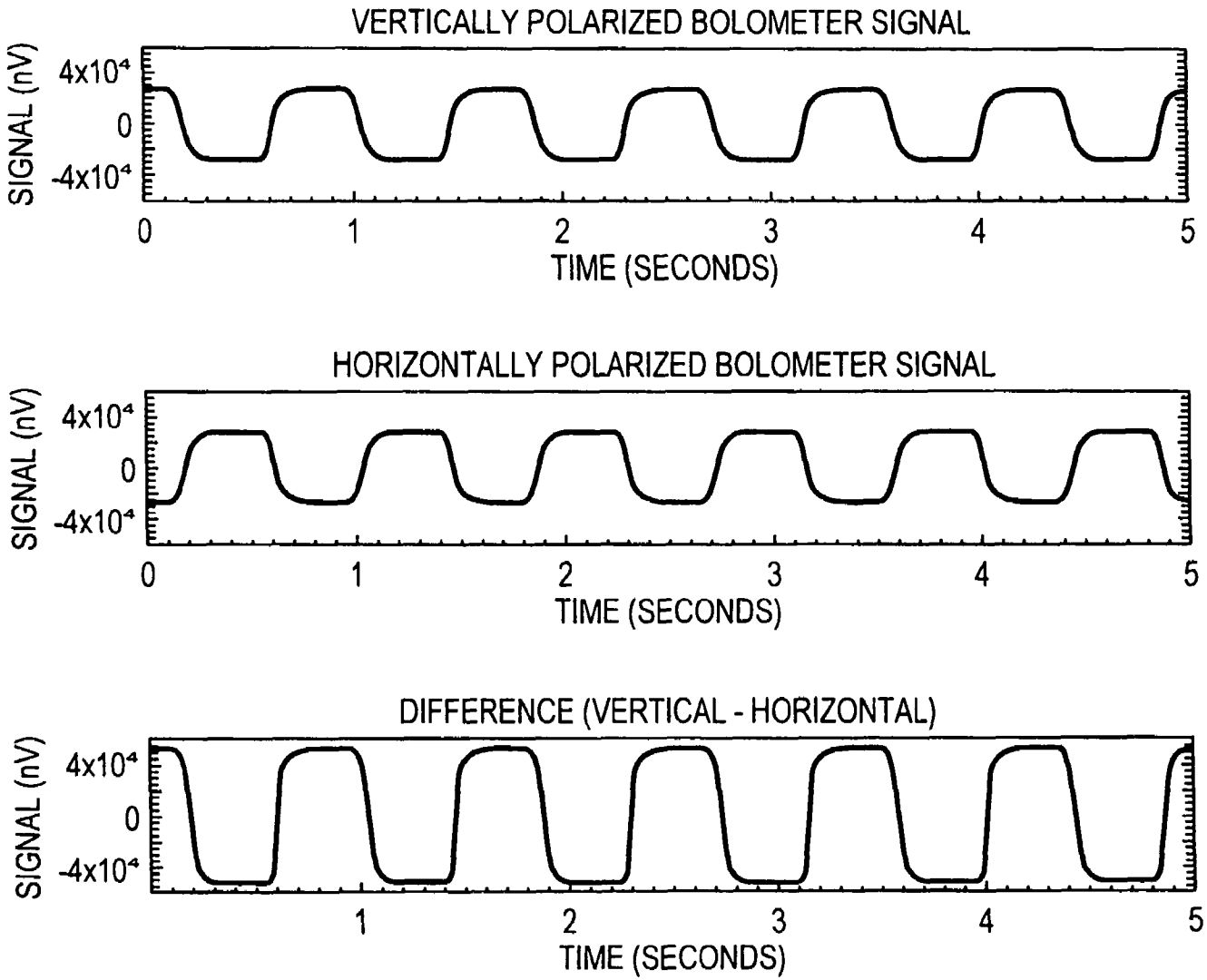
FIG. 13 shows an instrumental polarization measurement.

Instrumental polarization arises from asymmetry in the toothpick structure. Asymmetries arise both in the construction of the toothpick and its placement in the waveguide. Both the tilt of the toothpick and its concentricity in the waveguide must be controlled to minimize spurious mode conversion from the desired $HE^{11}$ mode to higher order modes. Mode conversion produces differential transmission of the two (degenerate) $HE^{11}$ polarization states, resulting in IP. In order to minimize IP, the alumina cones can be manufactured with ~0.5° base tilt and the ferrite cylinder faces can be made parallel to better than 0.1° and the assembled toothpick can be placed concentrically in the corrugated waveguide. When viewing unpolarized thermal loads at 300 K and 77 K the IP signals can be seen in real time when the polarization modulator is AC biased. As shown in FIG. 13, the observed 1% instrumental polarization is consistent with HFSS simulations of the polarization modulator with a 0.5° tilt of a ferrite/alumina toothpick with respect to the corrugated waveguide axis. Cross-polarization measurements are also in agreement with HFSS simulations and are consistent with non-orthogonality of the PSBs at the 1° level.

Depolarization arises due to differences in loss between the two helicity states which propagate in the ferrite. The two helicity states can be written in terms of the linear polarization states as: $RCP=(E_x\hat{x}+iE_y\hat{y})/\sqrt{2}$ and $LCP=(E_x\hat{x}-iE_y\hat{y})/\sqrt{2}$. At the operating frequencies of interest (~100 GHz)—well-above the Larmor resonance frequency of saturated TT2-111 ferrite (≃11 GHz)—the difference in attenuation coefficients between the two helicity states is $\alpha_+-\alpha_-<0.001$ Np/m. This implies that RCP electric fields are attenuated by $e^{\alpha+}=0.9968$ and LCP fields are attenuated by $e^{\alpha-}=0.9964$. This differential attenuation therefore results in depolarization (as opposed to instrumental polarization). The polarimeter's signal is the difference between the power in each polarization state, which is proportional to the difference in intensity between the orthogonal polarizations (which is also proportional to the Stokes Q parameter). So $$Q=|E_x^2|-|E_y^2|=2LCP\times RCP$$

implying $Q_{out}=0.993\,Q_{in}$ and $U_{out}=0.993\,U_{in}$. This shows that the polarization angle $$\tan^{-1}Q_{out}/U_{out}=\tan^{-1}Q_{in}/U_{in}$$

implying that the output polarized intensity is 99.6% of the input and there is no cross polarization (spurious conversion/rotation between $E_x\hat{x}$ and $E_y\hat{y}$ or, therefore, between Q and U).

All three polarimetric systematics have been found to be stable over periods of greater than 3 months. This is not surprising as the three polarimetric systematic effects are intrinsic to the materials used and/or caused by the construction. The stability of these offsets allows them to be modeled and subtracted from the data.

Magnetothermal Performance: The polarization modulator uses a superconducting solenoid having a magnetic bias $H_{applied}$≃30 Oersted. While large variations in the magnetic field can produce eddy current heating, careful thermal and magnetic design can minimize eddy currents induced in the modulator. In general, eddy current heating effects are proportional to the sample area transverse to the applied magnetic field. For a solenoid made with copper magnet wire, Joule heating of the coil dominates the electromagnetic loss. Eddy current dissipation in the metallic waveguides is ten times smaller than the coil dissipation at ~200 μW for a solenoid that produces the 30 Oersted field required to saturate a 5 Hz sinusoidally-biased ferrite. For a perfect superconducting coil, the coil loss is zero and the total modulator eddy current heating scales as the modulating frequency squared. Simulations using Maxwell SV, also offered by the Ansoft Corporation, are in excellent agreement with measurements of the eddy current dissipation of the Polarization modulator from DC to 20 Hz. For this test, magnetic shielding was accomplished by enclosing the solenoid in a high magnetic permeability jacket fabricated from Cryoperm 10.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A polarization modulator device for modulating a polarization of an electromagnetic wave comprising:

a corrugated metallic waveguide having an interior cylindrical opening defined therein and situated along a longitudinal axis of said waveguide, said waveguide including a plurality of corrugations, each corrugation having a tooth and a slot, said corrugated metallic waveguide also having a first waveguide section and a second waveguide section, said waveguide sections separated by a dielectric break, said dielectric break defined therein and situated substantially collinearly with said longitudinal axis of said waveguide in substantially a center of said waveguide;

a central structure situated along said longitudinal axis of said waveguide, said central structure including a cylinder having a permeability greater than 1, and two dielectric cones, said cylinder having two substantially circular end faces situated in perpendicular orientation to a longitudinal axis of said cylinder, each of said dielectric cones having a base mechanically coupled to an end face of said cylinder and a cone axis situated substantially collinearly with said longitudinal axis of said cylinder, said central structure supported substantially in said center of said interior cylindrical opening of said waveguide, said cylinder substantially situated within said dielectric break of said waveguide; and a magnetic field source, said magnetic field source configured to permit a controllable magnetic field in said cylinder, wherein said magnetic field modulates a polarization of the electromagnetic wave by an angle related to a strength of the magnetic field.

2. The device of claim 1 wherein said waveguide comprises gold plated copper.

3. The device of claim 1 wherein each tooth and slot of said waveguide forms a right circular cylinder.

4. The device of claim 1 wherein said ceramic cones comprise an alumina ceramic.

5. The device of claim 1 wherein said waveguide comprises a superconductor material.

6. The device of claim 5 wherein said superconductor material comprises niobium or aluminum.

7. The device of claim 1 wherein said central structure is supported by one or more dielectric supports.

8. The device of claim 7 wherein said one or more dielectric supports comprise one or more silica washers.

9. The device of claim 1 further comprising an absorber of Aluminum Nitride.

10. The device of claim 9 wherein the absorber is coated with a microwave absorber.

11. The device of claim 1 wherein said magnetic field source comprises a solenoid having solenoid windings.

12. The device of claim 11 wherein said solenoid having solenoid windings comprises a selected one of metallic windings and superconducting windings.

13. The device of claim 1 wherein said dielectric cylinder comprises a ceramic or a semiconductor.

14. The device of claim 13 wherein said ceramic comprises a ferrite ceramic.

15. The device of claim 13 wherein said semiconductor comprises germanium or garnet.

16. A polarimeter apparatus for measuring the polarization of an incident electromagnetic wave comprising:

a receiving structure configured to guide the incident electromagnetic wave into the polarimeter apparatus;

a polarization modulator device according to claim 1, said polarization modulation device mechanically coupled to said receiving structure;

an output structure mechanically coupled to said polarization modulator device;

a detector mechanically coupled to said output structure, said detector configured to generate a detector output signal; and an electronic measuring circuit configured to accept said detector output signal and configured to measure the polarization of the incident electromagnetic wave based at least in part upon said detector output signal.

17. The apparatus of claim 16 wherein said output structure is a microwave feedhorn.

18. The apparatus of claim 16 wherein said receiving structure is a microwave feedhorn.

19. The apparatus of claim 16 wherein said electronic measuring circuit includes a lock-in amplifier, and a reference input signal representative of said electrical current and an input signal representative of said detector signal.

20. The apparatus of claim 16 wherein said detector comprises a bolometer or an amplifier coupled to a semiconductor detector.

21. The apparatus of claim 16 wherein said detector is cooled to a temperature below 100 K.

22. The apparatus of claim 16 wherein said magnetic field source is an electrical solenoid.

23. The apparatus of claim 22 wherein said electrical solenoid comprises superconducting windings.

* * * * *